US005509742A

United States Patent [19]

Balzarini

[11] Patent Number: 5,509,742

[45] Date of Patent: Apr. 23, 1996

[54] MASCARA APPLICATOR AND MASCARA REMOVAL DEVICE

[76] Inventor: Grace M. Balzarini, 3551 Coronado Dr., #913, Sarasota, Fla. 34231

[21] Appl. No.: 410,133

[22] Filed: Mar. 23, 1995

[51] Int. Cl.[6] ..... A45D 40/24

[52] U.S. Cl. ..... 401/17; 401/18; 401/23; 401/126; 401/199

[58] Field of Search ..... 401/17, 18, 23, 401/126, 199

[56] References Cited

U.S. PATENT DOCUMENTS

| | | | |
|---|---|---|---|
| 2,736,050 | 2/1956 | Lee | 401/18 X |
| 3,103,032 | 9/1963 | Brenne | 401/18 X |
| 3,341,884 | 9/1967 | Pryor | 401/17 |
| 3,690,777 | 9/1972 | Costa | 401/18 X |
| 3,941,488 | 3/1976 | Maxwell | 401/17 |

FOREIGN PATENT DOCUMENTS

| | | | |
|---|---|---|---|
| 520862 | 7/1953 | Belgium | 401/17 |
| 1145096 | 10/1957 | France | 401/18 |
| 9119573 | 12/1991 | WIPO | 401/17 |

*Primary Examiner*—Steven A. Bratlie
*Attorney, Agent, or Firm*—Charles J. Prescott

[57] ABSTRACT

A cosmetic device for both application and removal of mascara. The mascara applicator includes a centrally positioned elongated main body from one end of which a mascara brush dependently extends and a mascara reservoir releasibly securable to this same end of the main body to both protectively encase the brush and to carry a supply of mascara therewithin. A mascara remover as a removable and separately useable subassembly includes a mascara remover reservoir for holding a quantity of liquid mascara remover and an absorbent tip dependently extending from one end of the reservoir. That same reservoir end is releasibly securable to the other end of the main body.

14 Claims, 2 Drawing Sheets

FIG. 3
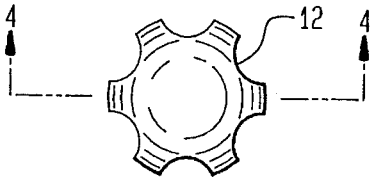
FIG. 2
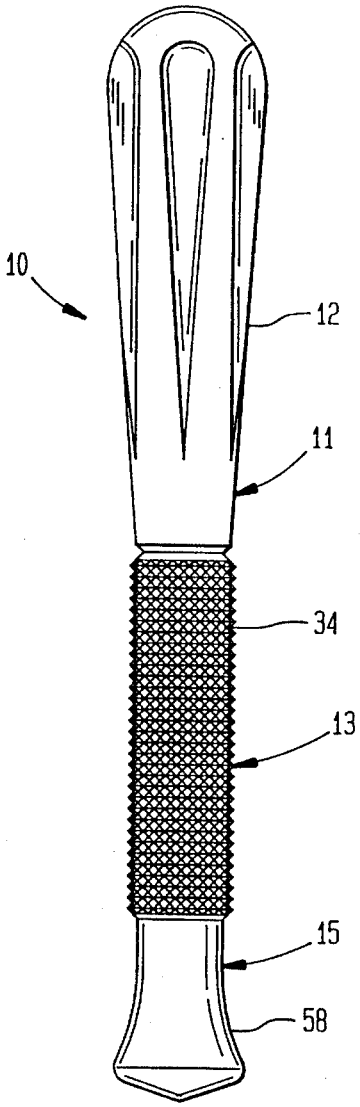
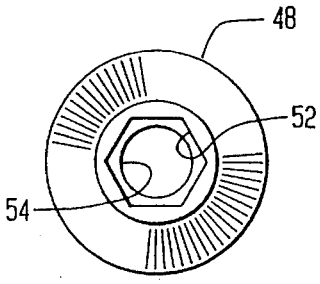
FIG. 5
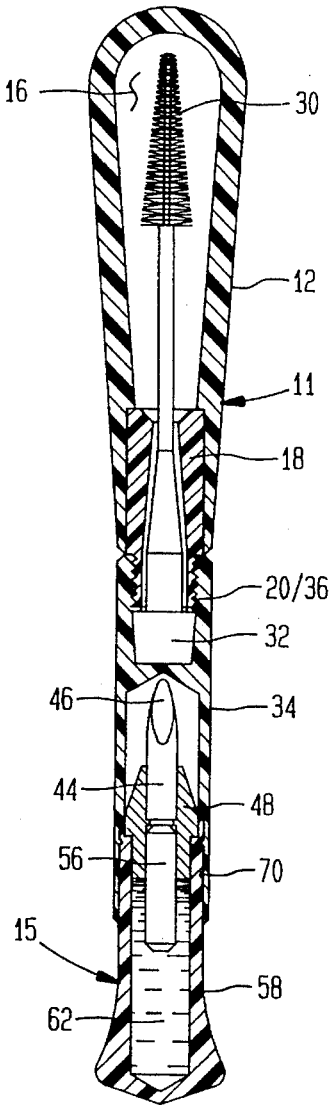
FIG. 4
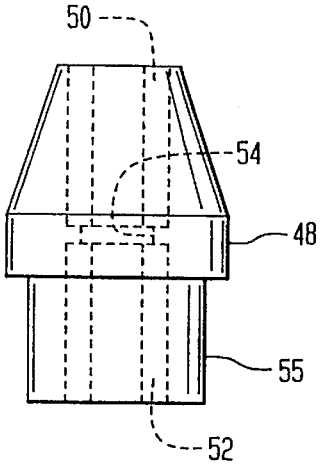
FIG. 6

MASCARA APPLICATOR AND MASCARA REMOVAL DEVICE

BACKGROUND OF THE INVENTION

1. Scope of Invention

This invention relates generally to cosmetic devices, and more particularly to a single device for selectively applying and removing mascara.

2. Prior Art

There are many cosmetic devices in use for the application of mascara. These devices generally include a brush, sometimes tapered, which is removably held within a reservoir which holds a quantity of mascara. Mascara is generally in very heavy liquid, paste or gel form so that it does not run and therefore the mascara reservoir need not be sealed either during storage or particularly during use. One such device is disclosed in U.S. Pat. No. 5,096,319 invented by Gueret.

The removal of mascara generally requires the use of a solvent to remoisten and soften the previously applied mascara. The solvent is typically supplied as a liquid to be applied to a cotton swab or tissue. Such a cosmetic liquid may also be referred to as an eye makeup remover or simply as mascara remover. A common ingredient for such a cosmetic liquid is mineral oil in combination with other ingredients such as lanolin oil, butylparaben, and other hypoallergenic ingredients as desired by the cosmetic manufacturer to enhance skin conditioning and the like.

There are a number of combination cosmetic devices. One such cosmetic combination device is disclosed in U.S. Pat. No. 3,690,777 which teaches a double dispensing applicator with twin reservoirs invented by Costa. This invention teaches a double-ended central member, each end defining a brush, one for eye lining and the other for applying mascara. Each end cap further defines both a handle and a cosmetic reservoir for the corresponding brush. Another combination cosmetic device is disclosed in U.S. Pat. No. 4,886,080 teaching a cosmetic container and assembly invented by Cole. This invention teaches side-by-side reservoirs for overlapping mascara applicator brushes, either of which may be selectively removed for use.

The present invention provides a combination mascara applicator with a mascara reservoir also serving as a carrying handle and a mascara remover unit or sub-assembly which is removable for separate use. The mascara remover unit includes its own liquid mascara remover reservoir and applicator tip which applies liquid remover and absorbs or collects the dissolved mascara.

BRIEF SUMMARY OF THE INVENTION

This invention is directed to a cosmetic device for both application and removal of mascara. The mascara applicator includes a centrally positioned elongated main body from one end of which a mascara brush dependently extends and a mascara reservoir releasibly securable to this same end of the main body to both protectively encase the brush and to carry a supply of mascara therewithin. A mascara remover as a removable and separately useable sub-assembly includes a mascara remover reservoir for holding a quantity of liquid mascara remover and an absorbent tip dependently extending from one end of the reservoir. That same reservoir end is releasibly securable to the other end of the main body.

It is therefore an object of this invention to provide a combination mascara applicator and mascara remover in a convenient unitized carrying package when not in use.

It is yet another object of this invention to provide a mascara applicator and remover which includes reservoirs for both mascara and liquid remover.

It is still another object of this invention to provide a mascara applicator and remover which includes a replaceable tip for dispensing liquid mascara remover and removing mascara.

In accordance with these and other objects which will become apparent hereinafter, the instant invention will now be described with reference to the accompanying drawings.

BRIEF DESCRIPTION OF THE DRAWINGS

FIG. 2 is a side elevation view of the invention in its stored configuration.

FIG. 3 is an end elevation view of FIG. 2.

FIG. 4 is a section view in the direction of arrows 4—4 in FIG. 3.

FIG. 5 is an end elevation view of the applicator tip holder (48) of the invention.

FIG. 6 is a side elevation view of FIG. 5.

DETAILED DESCRIPTION OF THE INVENTION

Figure 1:
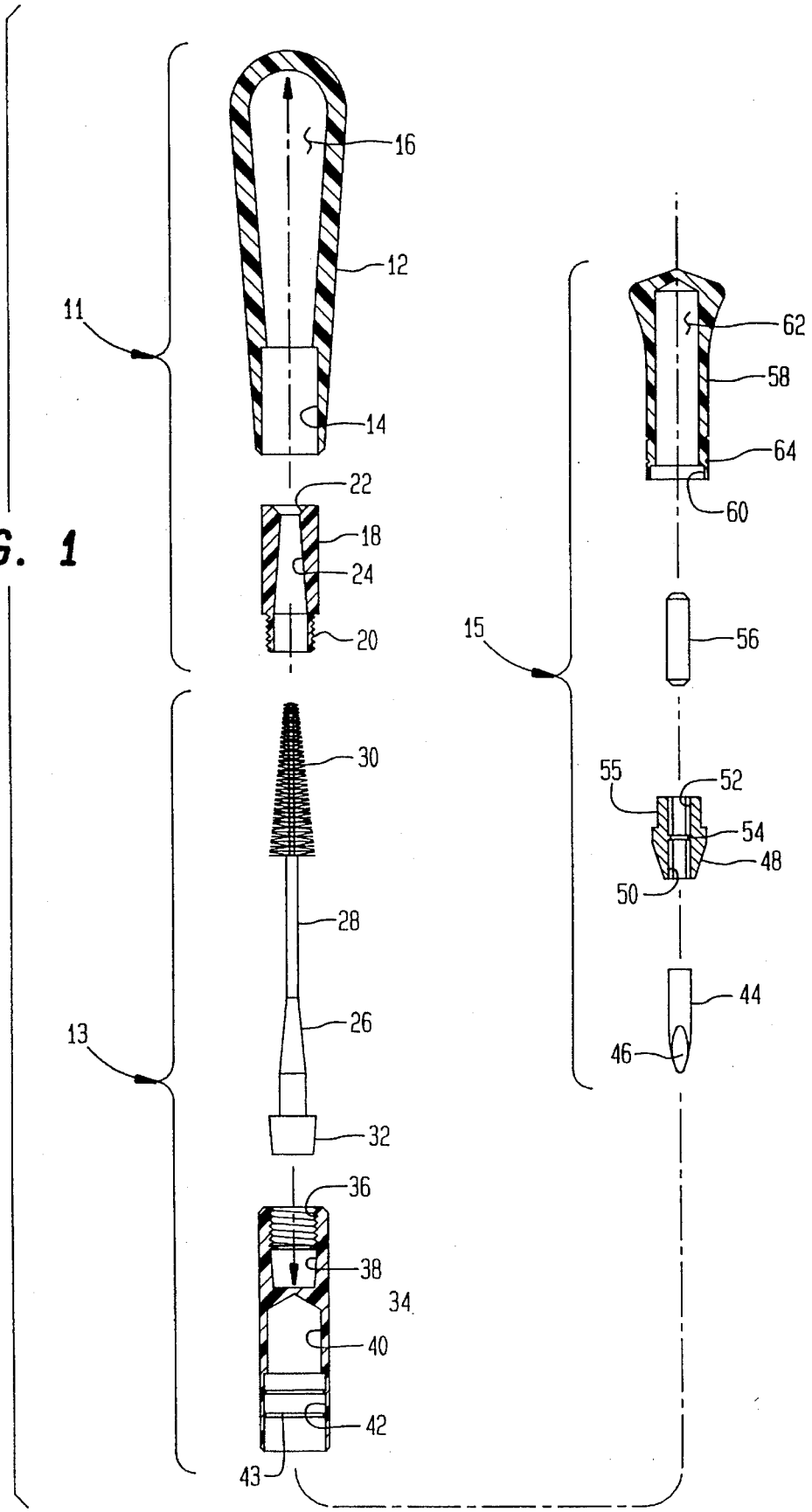
FIG. 1 is a side elevation exploded view of the invention.

Referring now to the drawings, the invention is shown generally at numeral 10 and includes, in broadest terms, a mascara applicator 13, a mascara reservoir unit 11, and a mascara remover unit 15.

The mascara applicator 13 as a sub-assembly or unit includes a slender, conically shaped mascara brush 30 connected onto an elongated slender shaft 28 enlarging at 26 to tapered base 32. The tapered base 32 snapably and lockably engages into a cavity 38 formed into one end of a cylindrical main body 34. This main body 34 is molded of plastic as are all major components of this invention. Formed into the same end of the main body 34 is a threaded cavity 36. A dual-diameter cavity at 40 and 42 is formed into the opposite end of the main body 34.

A mascara reservoir 12 defines an interior volume 16 for holding a quantity of mascara (not shown). The mascara reservoir 12 includes a cylindrical opening 14 formed into one end into which a mascara brush cleaning insert 18 is removably connected. This cleaning insert 18 includes an elongated tapered longitudinal cavity 24 narrowing at 22 so that, when brush 30 is removed therethrough from the mascara reservoir 12, excess mascara is left within the reservoir 12. The cleaning insert 18 is threaded at 20 so as to be secured into threaded cavity 36 of main body 34.

The mascara removal unit 15 includes a mascara remover reservoir 58 defining an interior volume 62. An open end 60 sealably and lockably engages with cylindrical surface 55 of the tip holder or support 48. As best seen in FIGS. 5 and 6, the tip holder 48 includes two hexagonal longitudinal cavities 50 and 52 separated by necked area 54. A cylindrical wick 56 formed of compressed absorbent felt or cotton material is snugly fitted within hexagonal cavity 52 positioned against necked area 54. An absorbent compressed fiber or cotton detailing tip 44 having a contoured end surface 46 is snugly fitted into the other hexagonal cavity 50. By this arrangement, the wick 56, in direct fluid contact with the interior volume 62 filled with liquid mascara remover, transfers by absorption the liquid mascara remover into the detailing tip 44 to keep the detailing tip 44 sufficiently saturated with mascara remover. By this arrangement, the detailing tip 44 may be easily removed and replaced without concern for dripping or spilling the mascara remover from internal volume 62.

The exterior peripheral surface of the mascara remover reservoir 58 includes two spaced O-ring grooves 64 for receiving O-rings 70. These O-rings 70 lockably and sealably engage into internal grooves 43 formed into cavity 42 of the main body 34. By this arrangement, the entire mascara remover unit 15 may be removed from the end cavity 42 of the main body 34 and then sealably and releasibly lockably engaged back into position within the main body when not in use. Moreover, when the mascara remover unit 15 is in its stored position within cavity 42 the otherwise exposed detail tip 44 is sealed within cavity 40 to prevent evaporation of the liquid mascara remover.

The exterior surface of the main body 34 is preferably knurled to enhance gripability of the device 10 and, in combination with the longitudinally fluted exterior structure of the mascara reservoir 12, adds distinctive appearance features.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In combination, a mascara applicator and mascara removal device comprising:

an elongated main body having a first and a second cavity formed into a first and a second end thereof, respectively;

a mascara applicator brush non-removably connected at one end and extending coaxially from said first cavity;

an elongated mascara reservoir for holding a quantity of highly viscous mascara therein and having an open end thereof sized for independent insertion and removal of said brush therethrough, an open end of said mascara reservoir releasibly securable to and coaxially extending from said main body first end to protectively encase said brush, a distal end of said mascara reservoir defining a closed end of said device;

an elongated mascara remover reservoir defining an interior volume for holding a quantity of liquid mascara remover therewithin;

an absorbent tip having a first end portion thereof sealingly connected into a first end of said mascara remover reservoir in fluid communication with said interior volume, said absorbent tip having a distal exposed second end portion thereof extending coaxially from said mascara remover reservoir configured for use in mascara removal;

said mascara remover reservoir first end releasibly securable to and coaxially extending from said main body second end independent of said mascara reservoir, a distal end of said mascara remover reservoir defining another closed end of said device and a handle for use in applying liquid mascara remover.

2. A device as set forth in claim 1, wherein:

said main body has a knurled exterior cylindrical surface for improved hand grasping.

3. A device as set forth in claim 1, wherein:

said tip is removable from said mascara remover reservoir for replacement and replenishment of liquid mascara remover supply.

4. A device as set forth in claim 1, further comprising:

means for sealing said mascara remover reservoir first end within said main body second end.

5. A device as set forth in claim 1, further comprising:

a brush cleaning insert connected within said mascara reservoir open end.

6. A device as set forth in claim 3, further comprising:

an elongated absorbent wick connected within said mascara remover reservoir in fluid communication with said interior volume and spaced end-to-end with said tip whereby liquid mascara remover is transferred to said tip from said wick, said wick preventing leakage of liquid mascara remover from said interior volume when said tip is removed for replacement.

7. A device as set forth in claim 3, wherein:

said tip is configured for both mascara removal and mascara blending.

8. A cosmetic device for selectively applying and removing mascara comprising:

a mascara applicator including:

an elongated main body having a first and a second cavity formed into a first and a second end thereof, respectively;

a mascara applicator brush connected at one end and extending coaxially from said first cavity;

an elongated mascara reservoir for holding a quantity of highly viscous mascara therein and having an open end thereof sized for insertion and removal of said brush therethrough, said mascara reservoir open end releasibly securable to and coaxially extending from said main body first end to protectively encase said brush, a distal end of said mascara reservoir defining one end of said device;

a mascara removal unit including:

an elongated mascara remover reservoir defining an interior volume for holding a quantity of liquid mascara remover therewithin;

an absorbent tip having a first end portion thereof sealingly connected into a first end of said mascara remover reservoir in fluid communication with said interior volume, said absorbent tip having a distal exposed second end portion thereof extending coaxially from said mascara remover reservoir configured for use in mascara removal;

said mascara remover reservoir first end releasibly sealably securable to and coaxially extending from said main body second end, a distal end of said mascara remover reservoir defining another end of said device and a handle for use in applying liquid mascara remover.

9. A cosmetic device as set forth in claim 8, wherein:

said main body has a knurled exterior cylindrical surface for improved hand grasping.

10. A cosmetic device as set forth in claim 8, wherein:

said tip is removable from said mascara remover reservoir for replacement and replenishment of liquid mascara remover supply.

11. A cosmetic device as set forth in claim 8, further comprising:

means for sealing said mascara remover reservoir first end within said main body second end.

12. A cosmetic device as set forth in claim 8, further comprising:

a brush cleaning insert connected within said mascara reservoir open end.

13. A cosmetic device as set forth in claim 10, further comprising:

an elongated absorbent wick connected within said mascara remover reservoir in fluid communication with said interior volume and spaced end-to-end with said tip whereby liquid mascara remover is transferred to said tip from said wick, said wick preventing leakage of liquid mascara remover from said interior volume when said tip is removed for replacement.

14. A cosmetic device as set forth in claim 10, wherein:

said tip is configured for both mascara removal and mascara blending.

* * * * *